US006325075B1

(12) United States Patent
Sheffler et al.

(10) Patent No.: US 6,325,075 B1
(45) Date of Patent: Dec. 4, 2001

(54) DEVICE FOR APPLYING GLITTER PARTICLES

(75) Inventors: Robert J. Sheffler, Morganville; Charles Chang, Wayne, both of NJ (US)

(73) Assignee: Topline Products Company, Inc., Wayne, NJ (US)

( * ) Notice: Subject to any disclaimer, the term of this patent is extended or adjusted under 35 U.S.C. 154(b) by 0 days.

(21) Appl. No.: 09/438,233

(22) Filed: Nov. 12, 1999

(51) Int. Cl.[7] ..... A45D 33/02; A45D 29/00

(52) U.S. Cl. ..... 132/298; 132/73; 132/307

(58) Field of Search ..... 132/298, 306, 132/307, 73, 73.5; 206/581; 220/4.27, 521, 522, 23.6, 23.86, 503, 504; 401/126, 18, 34

(56) References Cited

U.S. PATENT DOCUMENTS 4,903,870 * 2/1990 La Vange ..... 222/482
5,184,746 * 2/1993 Moore et al. ..... 220/256
5,350,424 * 9/1994 Shansky ..... 8/406
5,513,781 * 5/1996 Ullrich et al. ..... 222/565
5,551,608 * 9/1996 Moore et al. ..... 222/542
5,657,778 * 8/1997 Guert ..... 132/320
5,964,226 * 10/1999 Sobel ..... 132/108
6,059,473 * 5/2000 Gueret ..... 401/129
6,062,757 * 5/2000 Gueret ..... 401/122

* cited by examiner

*Primary Examiner*—John J. Wilson
*Assistant Examiner*—Robyn Kieu Doan

(57) ABSTRACT

A device for applying glitter particles and the like to a surface, has a container for storing said particles, said container having a discharge opening and a manually operable closure for closing the said discharge opening. The device has sifter means spanning the opening of the container, for effecting a sifter discharge of the container contents, and has a coaxially disposed handle means on the container, enabling the same to be readily shaken and manipulated for effecting said sifted discharge. The handle means comprises a vial having a top end and a bottom end, said vial being adapted to hold adhesive liquid and having a removable applicator device for applying said adhesive liquid to the surface which is to be coated.

12 Claims, 2 Drawing Sheets

Figure 5:
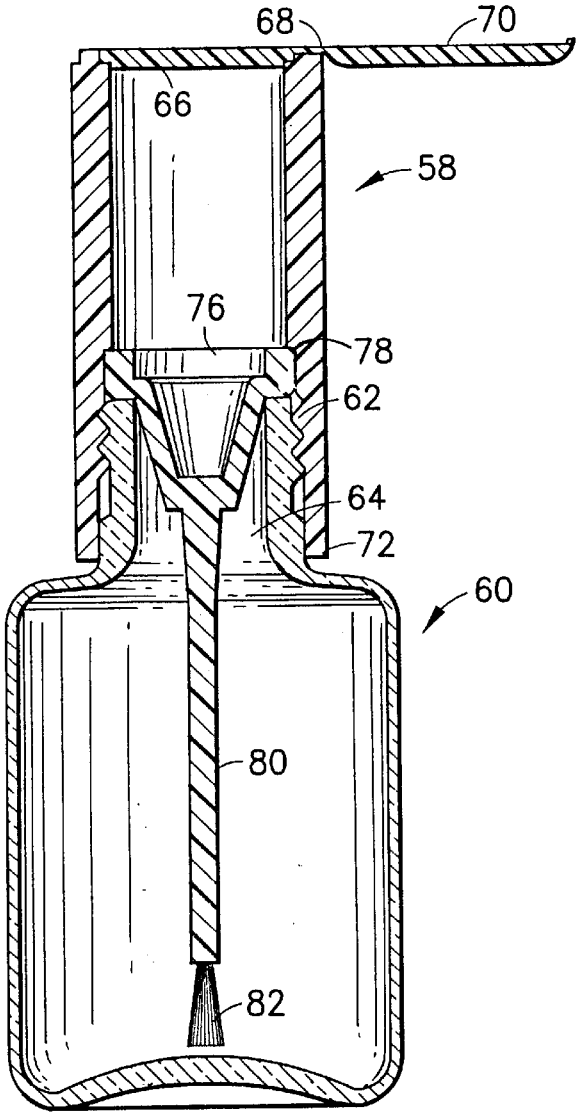

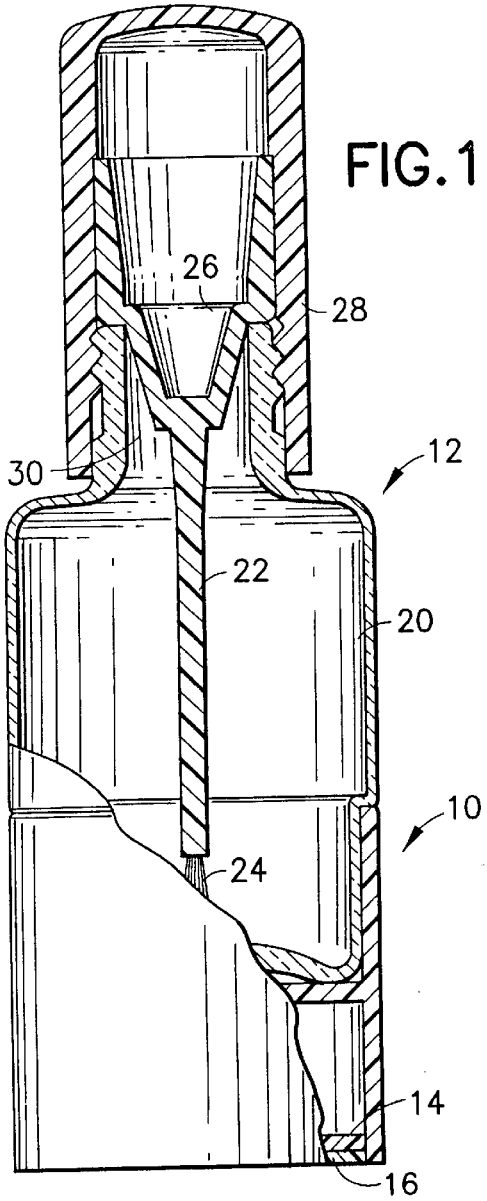
FIG.1
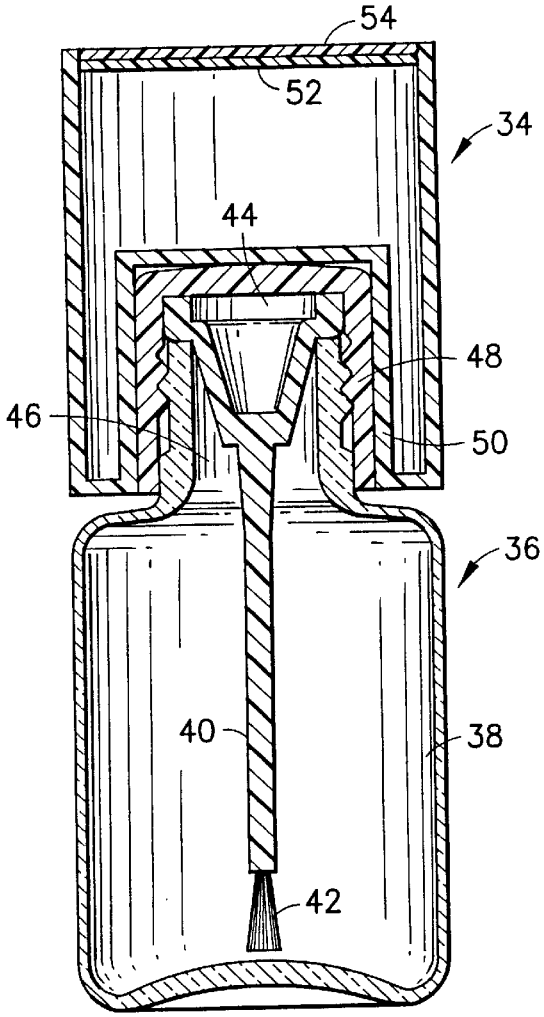
FIG.3
FIG.2
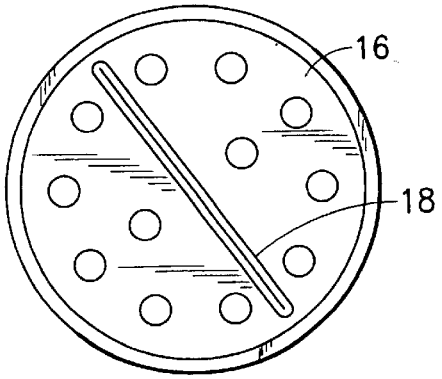
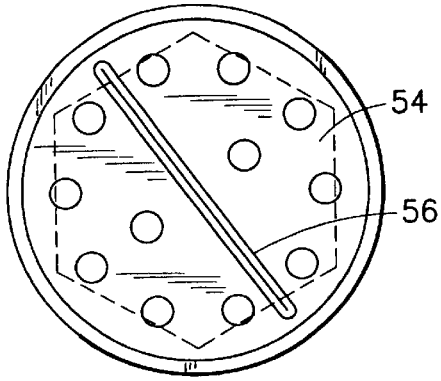
FIG.4

DEVICE FOR APPLYING GLITTER PARTICLES

STATEMENT AS TO RIGHTS TO INVENTIONS MADE UNDER FEDERALLY-SPONSORED RESEARCH AND DEVELOPMENT

Research and development of the present invention and application have not been Federally-sponsored, and no rights are given under any Federal program.

BACKGROUND OF THE INVENTION

1. Field of the Invention

This invention relates to the use of glitter particles and the like, and more particularly to the application of such particles to various surfaces, mainly for the ornamentation of the same.

2. Description of the Related Art Including Information Disclosed Under 37 CFR §§1.97–1.99 No Related Art Disclosed or Described The field of cosmetics enhancement of fingernails and toenails has been a popular activity over the years. In addition to the usual plain nail polishes and enamels the use of glitter particles has become widespread, these being dispersed in the adhesive liquid of the enamel or polish. A distinct drawback in the use of such materials has been the requirement that the liquid suspension required constant shaking to prevent the particles from settling and causing an inhomogeneous mixture to occur. Such mixture caused the product which was applied to the nails to give a less than desirable appearance and lustre.

Many of the glitter particles became occluded completely and wholly surrounded by solidified product, masking the glitter effect.

Also, if the shaking of the mixture was not properly done, as for one example, if the cap of the container was loose, leakage of the product, such as nail polish could occur. The polish would run down the exterior of the container and/or come in inadvertent contact with the user's skin or clothing while the shaking was being undertaken.

The above drawbacks and disadvantages of these prior devices which were intended for the application of glitter particles to the fingernails or toenails have been obviated by the present invention, and one object of the invention is to provide an improved device for use in ornamenting the fingernails or toenails, which is extremely simple and practical in insuring easy and effective proper application of glitter substances to surfaces which are to be ornamented.

Another object of the invention is to provide an improved device of the kind indicated, which is economical to produce and sell.

A further object of the invention is to provide an improved device as characterized above, which is not likely to result in spillage of the liquid or particulate contents of the device, thereby making it safer to use and more user friendly.

Another object of the invention is to provide an improved particulate applicator as above characterized, which is easily controlled to obtain the desired ornamental effects on the nails.

A feature of the invention resides in the provision of an improved applicator for glitter particulates in accordance with the foregoing, which can be easily operated by the user to obtain the desired ornamentation of the nails.

Other features and advantages will hereinafter appear.

In accomplishing the above objects the invention provides an applicator device essentially comprising a container for storing dry particulates or glitter particles, said container having a discharge opening and a manually operable closure for closing said discharge opening. The container further has a sifter means which spans its discharge opening for effecting a sifted discharge of the dry container contents, and also a special, user friendly coaxially disposed handle part which enables the container to be readily safely shaken and manipulated for effecting the sifted discharge. In the handle means there is a vial having top and bottom ends, which vial is adapted to hold adhesive liquid and which has a manually manipulatable applicator device that is removable from its top end for applying a coating of said adhesive liquid to the surface which is to be coated. After such coating has been applied, the dry glitter particles can be sifted onto the nails from the container that is provided, to obtain the desired ornamental effect.

In the accompanying drawings showing several embodiments of the invention:

FIG. 1 is a view partly in axial section and partly in side elevation, illustrating one embodiment of the invention wherein a vial containing applicator liquid and containing an applicator device is disposed axially of and as an extension of the container for the dry particulate, thereby to serve as a convenient handle for manipulating the latter. This embodiment permits the container for the glitter particles to be completely separated from that of the nail enamel, as they are joined only by light friction. This separation favors handling of the glitter without re-sealing the nail coating product.

FIG. 2 is a bottom plan view of the device of FIG. 1.

FIG. 3 is an axial sectional view of a second embodiment of the invention, wherein a container for the glitter particles is located axially above the discharge opening of the vial in which the adhesive liquid is carried, and wherein both the container for the glitter particles and the vial of adhesive liquid have essentially the same exterior diameter. Here again the two containers are held together only by light friction, and may be separated before the nail enamel and glitter are dispensed.

FIG. 4 is a top plan view of the device of FIG. 3.

Figure 6:
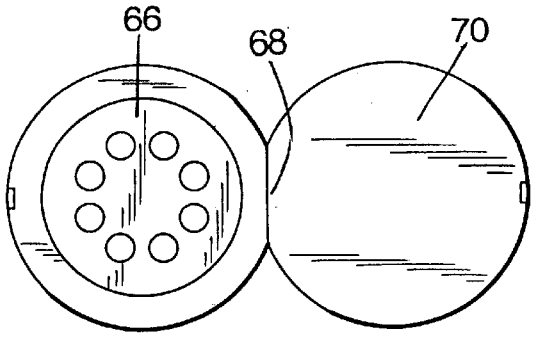

FIG. 5 is an axial sectional view of a third embodiment of the invention, wherein a container for the glitter particles is disposed axially above the vial of adhesive liquid, and comprises the closure for that vial, and wherein the glitter particle container is of smaller diameter than the vial of adhesive liquid and has its closure disk in open position, and FIG. 6 is a top plan view of the device of FIG. 5.

Referring first to FIGS. 1 and 2, the embodiment of the invention illustrated therein comprises essentially a container part designated generally by the numeral 10, said part being intended to carry glitter particles and having a handle means or part designated generally by the numeral 12 which is coaxially disposed with respect to the container part 10. The parts 10 and 12 can be telescopically fitted to each other by means of a friction fit to enable ease of assembly and separation as can be understood. However, preferably and in accordance with the present invention the parts 10 and 12 are fairly sufficiently held together by their frictional engagement whereby jointly if desirable, they can constitute a convenient handle means for moving and shaking the container part 10 as will be later brought out.

The container part 10 can be readily molded of plastic substance with an inner ledge at the bottom edge of the molding in a well known manner, thereby to support a perforated sifter part 14 which can be applied and secured in place after the container part has been filled with the glitter substance. The said inner ledge can be slightly undercut in a known manner to provide a circumferential track for accommodating a manually turnable, perforated sifter disk 16 which is snapped in place and is turnable in the track to open or close the sifter openings, all well known expedients. A diametric finger rib 18 on the member 16 facilitates manipulation of the member 16.

In accordance with the invention the handle part 12 is of appreciable size such that it can be readily grasped and manipulated for the purpose of firmly holding and shaking the container part 10 over the area which is to be decorated, as for example the fingernails or the toenails of the user. As shown, the handle means 10 in part is as large in diameter as the container part 10 and also of appreciable axial length, thereby making it especially easy to effect the desired holding and manipulation of the container part to reach most areas of the body, especially the toenails.

As provided by the invention, the handle part 12 includes a vial 20 which is adapted to contain an adhesive liquid (not shown) and an applicator for such liquid, the latter comprising a stem 22 having a brush 24 and also having a stopper 26 for tightly closing the vial. The stopper 26 is normally kept in its sealing position by a screw cap 28 which is threaded onto the externally threaded and reduced diameter neck 30 of the vial 20. The cap 28 is tightly fitted to the stopper 26, and both extend an appreciable distance axially and away from the threaded neck 30 of the vial, thereby to provide a good grip for the handle part 12 in addition to the grip provided by the large diameter portion of the vial 20.

In use of the device, the user merely unscrews the cap 28 and uses the applicator in a manner similar to the applying of nail enamel, to coat the adhesive liquid on the fingernails or other desired surfaces. The cap 28 can now be replaced, and thereafter the sifter stopper can be opened and the sifter manipulated or shaken to sift the glitter particles to the desired coated areas. Or, as an alternative, the container 10 can be pulled off of the vial 20 and used by itself to sprinkle the glitter particles. In either event, the operation of properly applying the desired amount of glitter particles to indicated surfaces has been greatly simplified and made easy.

As an alternative to the above procedure, and useful especially where the adhesive liquid in the vial 20 is of the very quick drying variety the application of the glitter particles to the fingernails or toenails can be conveniently completed one nail at a time. For such occasion, the applicator stem 22 is merely replaced in the conveniently located vial and the cap 28 tightened prior to shaking and sifting of the particles on the coated surface. It will be understood that in accordance with this invention this can be easily done each time that the coating of a nail is completed and prior to any appreciable drying of the coating.

Another embodiment of the invention is illustrated in FIGS. 3 and 4, wherein the shaker-sifter is located at the top of the vial containing the adhesive liquid. In these figures the container part is designated generally by the numeral 34, and the handle part is designated 36. This handle part is constituted mainly of a vial 38 which has an applicator stem 40 with brush 42 carried by a stopper 44 that seats on the reduced neck portion 46 of the vial. A screw cap 48 threads on the neck portion 46 to securely hold the stopper 44 in sealing position.

In accordance with this invention the container part 34 may be tightly secured to the cap 48, having a deep socket configuration 50 which receives the cap 48 for this purpose. The configuration 50 can be cemented or otherwise secured to the cap 48, as will be understood.

As with the other embodiments of the invention, the container part is in the form of a cylinder open at the end, which receives the sifter means. This end has at its edge an internal ledge on which the stationary sifter member 52 is secured. The ledge is deep enough to accommodate a rotary sifter disk 54 having a finger engageable diametric rib 56 for effecting its turning, as with the previous embodiment.

In operation, the container part 34 is unscrewed and removed, carrying with it the applicator stem 40 while the vial part functions at this point as the "handle" of the device, being held in the hand while the container part and applicator are being used to apply the adhesive liquid to the fingernail or toenail. Then the container part and applicator are replaced on the vial 38 and tightened, and the sifter member 54 opened to enable the glitter particles to be sifted onto the nail. The vial 38 is functioning as at least part of the handle means for the device, the remainder of the handle means being considered as the lower portions of the side walls of the container part.

Another embodiment of the invention is illustrated in FIGS. 5 and 6. In this embodiment the container part is designated generally by the numeral 58 and the handle means designated by the numeral 60. As in FIG. 3 the container part 58 is disposed above the handle means or part 60 but as shown it is of smaller diameter, eliminating the need for the large socket configuration 50 of the handle part 36.

Actually, as seen in FIG. 5 the container part 58 constitutes the screw cap for the vial or handle part 60. For this purpose the container part has internal screw threads 62 which thread onto the threaded neck portion 64 of the vial or handle means 60 of the device.

At its top edge portion the container part 58 has an inner ledge in which a perforated sifter disk 66 is fixedly seated, such disk being connected by a living hinge 68 with a closure flap or disk 70 in a known manner.

The bottom edge 72 of the container part or cap 58 rests against and is guided by a shoulder formation on the reduced neck portion 64 of the vial or handle part 60.

A closure and sealing plug 76 seats on the edge of the vial 60 and also engages an internal shoulder 78 in the container part, to effect the seal.

When the container part or cap 58 is unscrewed, the plug 76 stays with it. The plug 76 carries a stem 80 and a brush 82 which constitute an applicator for applying adhesive liquid to the surface which is to be coated with the glitter particles. Either small portions or else large areas can be coated with the adhesive liquid prior to closing the vial 60 and opening the top 70 of the sifter for doing the sifting.

It will now be seen from the foregoing that we have provided improved combination glitter applying devices which are extremely convenient and easy to use, simple in construction, and economical to fabricate. The devices operate efficiently, and are reliable in their use, and make the application of glitter particles to the fingernails and toenails especially simple and easily carried out.

Each and every one of the appended claims defines an aspect of the invention which is separate and distinct from all others, and accordingly it is intended that each claim be treated in this manner when examined in the light of the prior art devices in any determination of novelty or validity.

LISTING OF NUMERALS

10. Container part
12. Handle means or part
14. Sifter part
16. Sifter disk
18. Diametric rib
20. Vial
22. Applicator stem
24. Brush

26. Stopper
28. Screw cap
30. Reduced neck
34. Container part
36. Handle part
38. Vial
40. Applicator Stem
42. Brush
44. Stopper
46. Neck portion
48. Screw cap
50. Socket configuration
52. Sifter member
54. Sifter disk
56. Diametric rib
58. Vial
59. Container part
60. Handle means
62. Internal screw threads
64. Threaded neck portion
66. Sifter disk
68. Living hinge
70. Closure disk
72. Bottom edge
74. Reduced neck portion
76. Sealing plug
80. Stem
82. Brush

What is claimed is:

1. A device for applying glitter particles and the like to a surface, comprising in combination:

(a) a container for storing said particles, (b) said container having a discharge opening and a manually operable closure for closing said discharge opening, (c) sifter mean spanning the opening of the container, for effecting, a sifter discharge of the container contents, (d) coaxially disposed handle means on the container, enabling the same to be readily shaken and manipulated for effecting said sifted discharge, and (e) said handle means comprising a vial having a top end and a bottom end, said vial being adapted to hold adhesive liquid and having a removable applicator device for applying said adhesive liquid to the surface which is to be coated.

2. A device as set forth in claim 1, wherein the container is disposed at the bottom end of the vial.

3. A device as set forth in claim 1, wherein the container is disposed at the top end of the vial.

4. A device as set forth in claim 3, wherein the container and the vial are of the same diameter.

5. A device as set forth in claim 3, wherein the vial diameter is larger than the container diameter.

6. A device as set forth in claim 2, wherein the container size and the vial size are essentially the same.

7. A device as set forth in claim 6, wherein the container has a socket adapted to receive the top portion of the vial.

8. A device as set forth in claim 3, wherein the container has a recess in which the top portion of the vial is received.

9. A device as set forth in claim 3, wherein the container and vial are screwed together.

10. A device as set forth in claim 5, wherein the container and vial are screwed together.

11. A device as set forth in claim 5, wherein the vial has a reduced neck and the container comprises a screw cap adapted to be screwed onto the reduced neck of the vial.

12. A device as set forth in claim 11, wherein the applicator has a sealing stopper and the container has a shoulder engaged with the said stopper.

* * * * *